US005823737A

United States Patent [19]

Cook

[11] Patent Number: 5,823,737

[45] Date of Patent: Oct. 20, 1998

[54] PROBEMAT HANDLER

[75] Inventor: Ralph D. Cook, Arvada, Colo.

[73] Assignee: Lucent Technologies, Murray Hill, N.J.

[21] Appl. No.: 948,957

[22] Filed: Oct. 10, 1997

Related U.S. Application Data

[63] Continuation of Ser. No. 550,697, Oct. 31, 1995, abandoned.

[51] Int. Cl.[6] ..... B66F 9/18

[52] U.S. Cl. ..... 414/621; 414/451; 414/667

[58] Field of Search ..... 8/450; 414/451, 414/618, 619, 621, 664, 667, 668, 671

[56] References Cited

U.S. PATENT DOCUMENTS

| | | | |
|---|---|---|---|
| 3,104,023 | 9/1963 | Smith et al. | 414/621 |
| 3,232,465 | 2/1966 | Romine et al. | 414/668 |
| 3,511,263 | 5/1970 | Emke | 414/621 X |
| 3,830,388 | 8/1974 | Mott | 414/621 X |
| 4,185,944 | 1/1980 | Seaberg | 414/621 |
| 4,279,564 | 7/1981 | Weinert | 414/621 |
| 4,279,604 | 7/1981 | Kooi et al. | 414/667 |
| 4,357,062 | 11/1982 | Everett | 339/18 R |
| 4,642,020 | 2/1987 | Sinclair | 414/621 |
| 4,774,462 | 9/1988 | Black | 324/158 F |
| 4,818,933 | 4/1989 | Kerschner et al. | 324/158 F |
| 4,857,009 | 8/1989 | Christensen | 439/372 |
| 4,993,136 | 2/1991 | Kerschner et al. | 29/401.1 |
| 5,018,930 | 5/1991 | Hardin et al. | 414/458 |
| 5,055,779 | 10/1991 | Kerschner et al. | 324/158 F |
| 5,094,584 | 3/1992 | Bullock | 414/786 |
| 5,104,277 | 4/1992 | Bullock | 414/280 |
| 5,114,118 | 5/1992 | Schrader | 254/8 R |
| 5,153,504 | 10/1992 | Bonnet et al. | 324/158 F |
| 5,190,436 | 3/1993 | Sorlie | 414/671 X |
| 5,285,149 | 2/1994 | Galdik et al. | 324/158 F |
| 5,307,560 | 5/1994 | Aksu | 29/842 |
| 5,336,039 | 8/1994 | House | 414/621 |
| 5,357,671 | 10/1994 | Gladik et al. | 29/739 |
| 5,422,575 | 6/1995 | Ferrer et al. | 324/754 |

FOREIGN PATENT DOCUMENTS

| | | | |
|---|---|---|---|
| 3007899 | 9/1981 | Germany | 414/668 |
| 3249100 | 11/1991 | Japan | 414/621 |
| 8102885 | 10/1981 | WIPO | 414/671 |

*Primary Examiner*—James W. Keenan

[57] ABSTRACT

An apparatus for lifting, carrying, and positioning probemats or fixtures. The apparatus comprises movable opposing side arms having a mechanism for receipt of a fixture handle, as well as a stationary support member. An arrangement is provided to connect the side arms to the support member by the use of a first track positioned on the front of the support member and a second track positioned on the rear of the support member. First and second rollers for rolling engagement with the tracks are connected to each side arm to support the weight of the side arm and to permit each side arm to slidably move along the tracks. The fixture handler also includes jaws comprising a channel and stops at the ends of the channel to permit the handler to be used with a plurality of different fixtures handles. Finally, an insert is provided for use with the jaws to further enhance the ability of the fixture handler to support a myriad of fixture types.

9 Claims, 8 Drawing Sheets

PROBEMAT HANDLER

This is a continuation of application Ser. No. 08/550,697 filed on Oct. 31, 1995, now abandoned.

FIELD OF THE INVENTION

The present invention relates to the field of probemat or fixture handling, and in particular to an apparatus for lifting, carrying and positioning probemats or fixtures.

BACKGROUND OF THE INVENTION

Today, it is common to subject printed circuit boards to a wide variety of test procedures and environments, including the performance of electrical tests to ensure the quality and reliability of the circuit. Generally, electrical testing is accomplished by the use of programmable automatic test equipment (ATE). ATE systems are capable of providing necessary inputs to the circuit and measuring the outputs resulting by application of those inputs to ascertain whether the circuit is properly performing. To permit ATE equipment to be used with a plurality of different printed circuit boards, an array of electrical contact points (a "bed of nails") are provided. Thus, to test a particular circuit, the inputs and outputs of that circuit must necessarily be electrically connected to the array of contacts on the ATE. This is accomplished by placing the printed circuit board into a fixture or probemat built for that circuit.

An ATE fixture or probemat is circuit specific as the specific inputs and outputs of the circuit must ultimately be connected to the electrical contacts of the ATE. Several types of probemats have been developed to deal with the circuit specificity. Conventional probemats are those only having enough electrical contacts for testing the particular circuit, i.e., contacts corresponding to only the inputs and outputs of the circuit. As explained in U.S. Pat. No. 4,774,462, however, such probemats are costly, time consuming to produce (thereby delaying production schedules), require considerable storage space when not in use, and are bulky and heavy, posing handling problems for personnel responsible for loading or unloading such fixtures.

In response to these shortcomings, universal probemats were developed. Universal probemats usually contain an array of electrical contact points capable of connection with each of the contacts in the array of the ATE. Universal probemats are not, however, without drawbacks themselves. Large forces are required to connect the fixture to the ATE, the fixture cannot be used on boards whose test points do not lie on the array, and a large capacity, expensive ATE system is generally required. An example of a universal probemat is found in U.S. Pat. No. 4,357,062.

Another type of probemat uses a special programming card (specific for each different printed circuit board type) to connect the board to the grid of electrical contacts of the probemat. Yet another type uses offset probes which provide connection to the ATE system (see U.S. Pat. No. 4,774,462, for example).

Regardless of the type of probemat employed, a mechanism must be provided to move the probemat into position in the ATE and to remove the probemat from the ATE. Many systems require that a human place the probemat onto the ATE, though some automated systems are provided. In U.S. Pat Nos. 5,104,277 and 5,094,584, for example, an automated system for storing, retrieving, and loading test fixtures from a storage facility to the ATE is disclosed. Essentially, the probemats used with this apparatus have edges capable of receipt by the horizontally extending opposing tracks of the storage apparatus and of the transporting apparatus of the system. Robotics technology is used to move the probemats.

U.S. Pat. Nos. 5,055,779, 4,993,136 and 4,818,933 disclose a system for handling and testing a printed circuit board having devices at fixed predetermined locations. The system includes a conveyor for moving the board from a remote position into the test position of the ATE. In this system, the probemats have handles extending from the edge thereof for placement of the probemat onto the conveyor of the apparatus.

Neither of these loading systems addresses the problems associated with the general transport of probemats. Many ATE systems do not provide a mechanism for automatic loading of the fixture onto the test bed. Further, even if such a loading system exists, it is still necessary place the fixture onto the loading means, or perhaps into the storage means, as in U.S. Pat. Nos. 5,055,779, 4,993,136 and 4,818,933.

As previously stated, probemats are often heavy and bulky. Thus, requiring personnel to lift and transport probemats places the person, the probemat and the circuit at risk. The person handles the probemat at the risk of incurring injury. The probemat and circuit may be damaged as improper handling may cause physical damage to the probemat or the circuit, or the inadvertent introduction of electrical current to the probemat and/or circuit may damage the electronic components of the printed circuit board or the probemat itself. Therefore, it is desirable to provide an apparatus for lifting and transporting probemats to reduce the potential for harm to an individual or to the probemat or circuitry as may result if lifted and carried by an individual.

Regardless of whether an ATE system includes an automatic loading mechanism, it is still necessary for the probemat to be placed into proper position. This may include placement of the probemat at an angle corresponding to the angle of the ATE system. For example, the test beds of Hewlett-Packard's HP 3070 and HP 3065 ATE systems are at an angle. Therefore, it is desirable to provide an apparatus suitable for placement of the probemat in a predetermined position, including an angled position.

Probemats vary in size, shape, and weight and also vary in the type of mechanism provided for transport of the probemat. The size, shape and weight are determined by many factors, including the type of circuit being testing, the type of ATE equipment, and whether an automatic handling system is used in connection with or as a part of the ATE system. The probemat often contains handles intended for use by humans when carrying the probemat. For example, the Hewlett-Packard SL L303 probemat includes handles of a particular shape and length. (See FIGS. 7A–7B herein). To transport this probemat, Hewlett-Packard suggests that it customers purchase the Alum-A-Lift Model 200TF lift available from Alum-A-Lift in Winston, Ga. and an end-effector (Product No. 44813A) from Hewlett-Packard. The combination of the lift and end-effector are, however, specific to the Hewlett-Packard ATE systems and Hewlett-Packard probemats having handles of a particular shape and dimension. Unless modification is made to the apparatus, it cannot lift and position other probemats. It is therefore desirable to provide an apparatus for lifting, transporting and positioning a probemat that may be used with a plurality of different probemat types including those of differing shapes, sizes, and weights, and those recommended for use in various ATE systems.

SUMMARY OF THE INVENTION

The present invention provides an apparatus for transporting and maneuvering probemats or fixtures used with automatic test equipment for testing printed circuit boards.

According to the present invention, a universal fixture handling apparatus is provided. The universality of the apparatus arises, in part, from the handler's ability to raise, lower and tilt a fixture held between the jaws of the handler. The jaws are also of a form suitable to receive a myriad of known fixture handles or edges intended for holding the fixture. Specifically, each jaw comprises a formed channel having stops at each end of the channel, and is of a length and overall dimensions to accommodate numerous handle types. For those fixtures handles which do not fit into the channel of the jaw, the invention discloses an insert used in conjunction with the jaw. The jaw insert is shaped to be received by the channel of the jaw, and to extend outside the jaw. The portion of the jaw extending outside the jaw receives the fixture handle. Thus, various configurations of jaw inserts may be used in conjunction with the jaw of the present invention.

An arrangement for connecting the side arms of the handler to the support member of the handler is also provided with the present invention. Tracks are provided on both the front and the back of the support member for rolling engagement with rollers connected to the side arm. This configuration supports the weight of the side arm while permitting for easy sliding of the side arm with respect to the support member. This arrangement reduces the amount of physical stress placed on the rollers, tracks and support members when compared to prior art fixture handling systems.

The fixture handler of the present invention is comprised of relatively few components, resulting in a handler that is inexpensive to manufacture. Further, the use of "off-the-shelf" components assists in creating a reliable units, as well as in minimizing the costs associated with the operation, repair and maintenance of the fixture handler. The simplicity of structure limits the overall dimensions of the handler to enhance its maneuverability. Also, the provision of a low-cost handler encourages the use of such an apparatus for lifting, carrying and positioning fixtures, rather than using human labor for such tasks, thereby reducing the possibility of injury to persons or to the fixture or a printed circuit board held by the fixture.

The above discussed features, as well as additional features and advantages of the present invention, will become more readily apparent by reference to the following detailed description and the accompanying drawings.

DETAILED DESCRIPTION OF THE DRAWINGS

Figure 1:
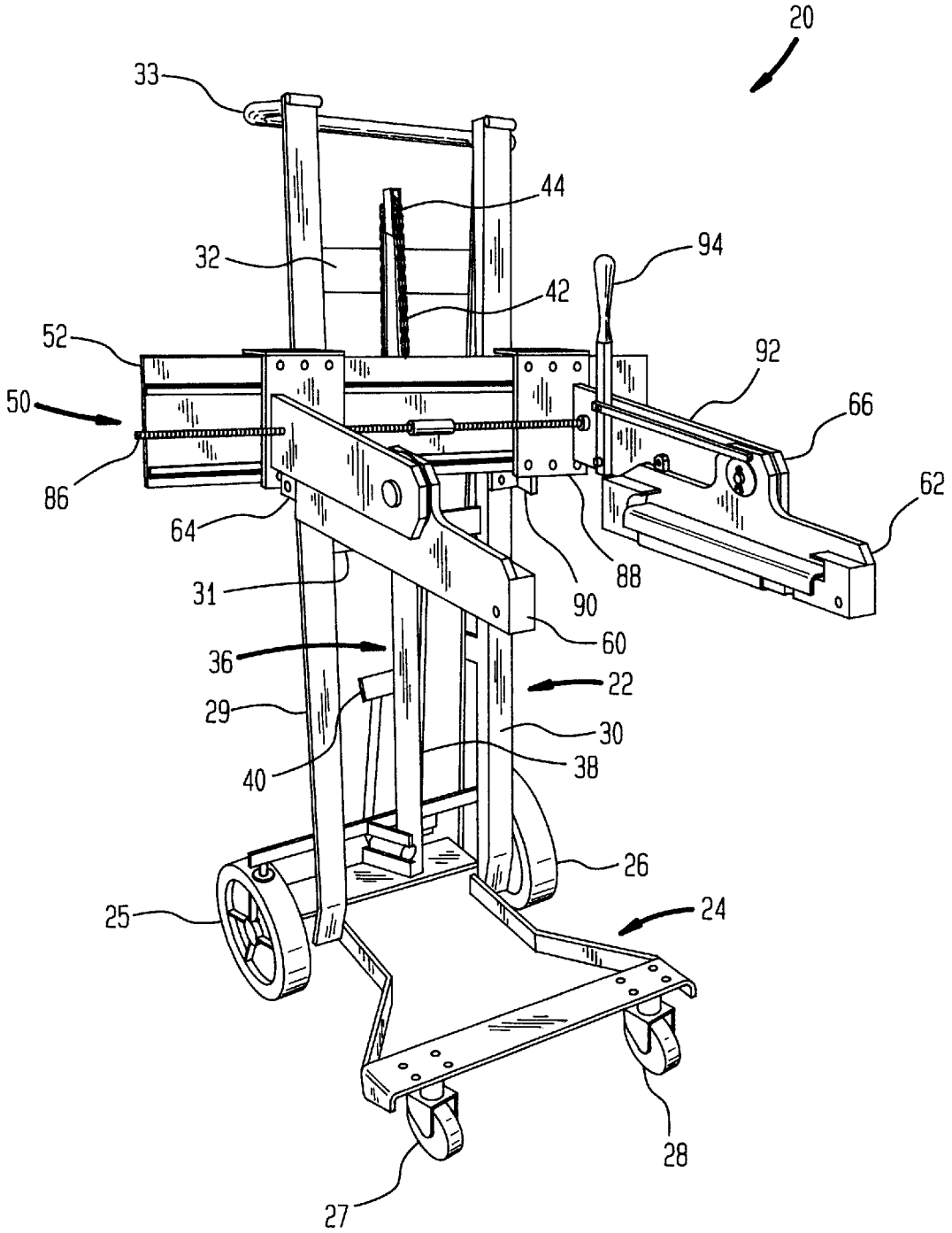
FIG. 1 illustrates a front perspective view of one embodiment of the probemat handler of the present invention.
Figure 2:
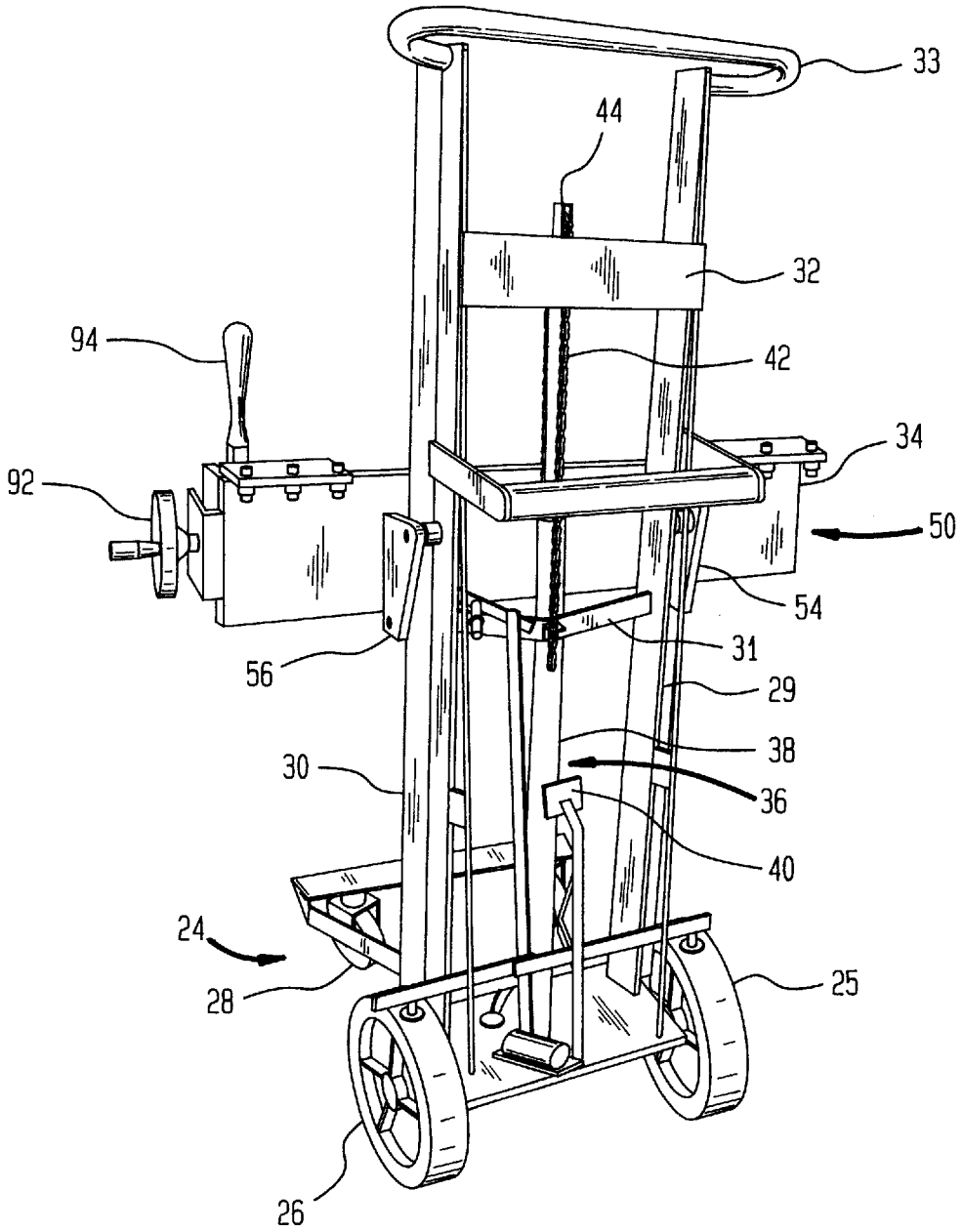
FIG. 2 illustrates a rear perspective view of the probemat handler of FIG. 1.

FIGS. 1 and 2 illustrate front and rear perspective views, respectively, of one embodiment of the probemat handler according to the present invention. In this embodiment, probemat handler 20 comprises frame 22 including lower frame assembly 24 having wheels 25–28 rotatably attached thereto. Also attached to lower frame assembly 24 are first and second upright support members 29 and 30. Joining first and second upright support members 29 and 30 are first and second cross-support members 31 and 32 and top support member 33 as shown. Handle 34 is attached to first and second upright support members 29 and 30 to assist in maneuvering frame 22 and to protect an operator from the moving parts of hoist system 36, described in further detail herein.

It will be appreciated by those of skill in the art that frame 22 of probemat handler 20 is skeletal in nature, providing a lightweight, portable unit. Further, with the exception of the handling mechanism described in further detail herein, frame 22 is narrow and with little depth, thereby permitting probemat handler 20 to be easily maneuvered to, from and near an ATE system. Also, skeletal frame 22 does not obstruct the vision of an operator positioned behind frame 22 when the operator is lifting, carrying or positioning a probemat held in the handling mechanism of probemat handler 20.

In addition to frame 22, probemat handler 20 includes hoist system 36 and handling assembly 50. In this embodiment hoist system 36 comprises a modified hydraulic hoist, such as Model No. DPL-54-2222, manufactured by Wesco Manufacturing Co., and available from Associates Material Handling of Denver, Colo. Hoist system 36 includes hydraulic pump and cylinder 38 actuated by foot pump 40. Pump and cylinder 38 is connected to one end of chain 42. The other end of chain 42 is operatively connected to base plate 52 of handling assembly 50. Chain 42 also extends over pulley 44 which is connected to the top end of the hydraulic shaft.

Figure 3A:
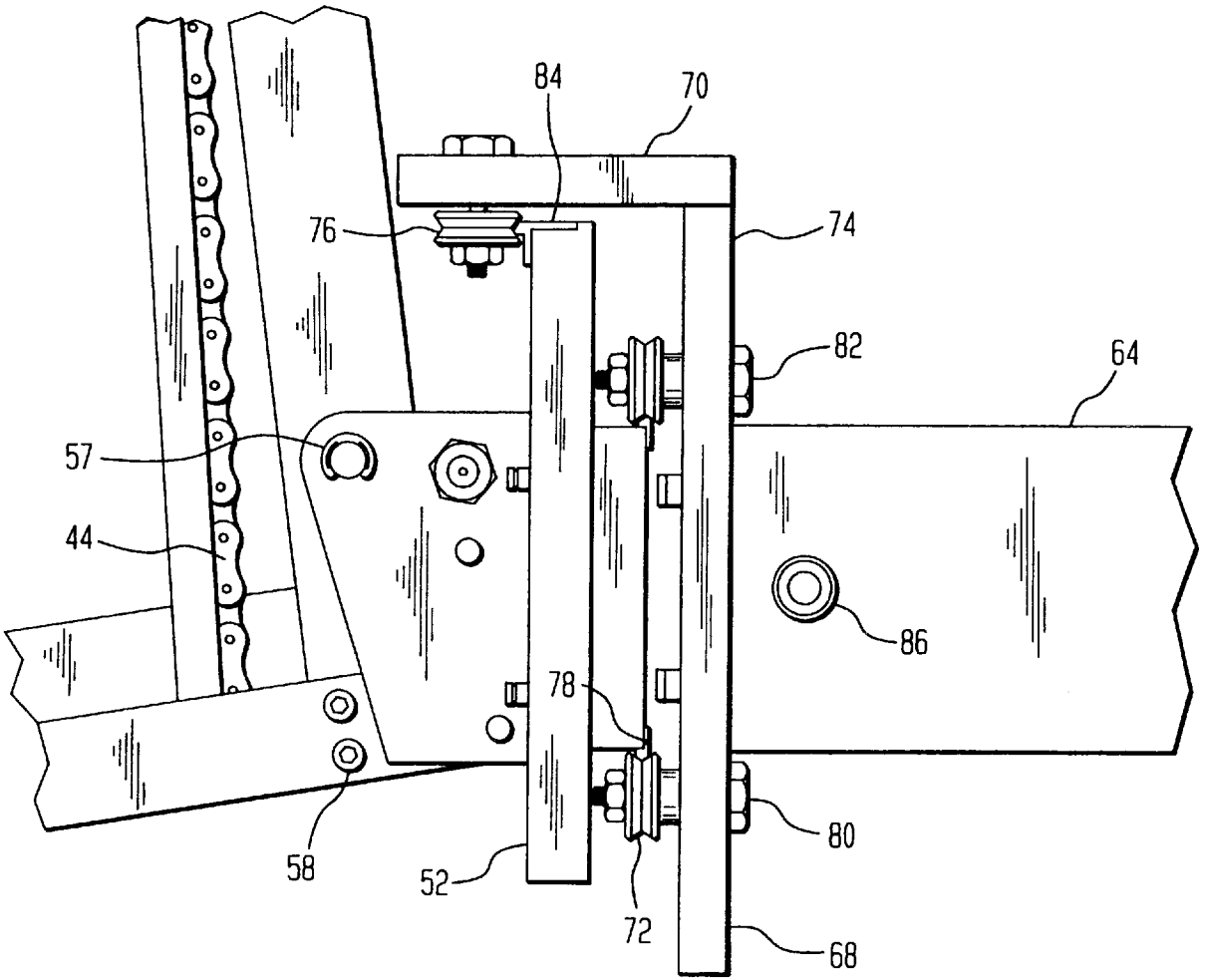
FIG. 3A illustrates a partial side view of the point of engagement of one side arm of the probemat handler to the base plate of the probemat handler.

Base plate 52, which supports handling mechanism 50, is slidably connected to first and second vertical support members 29 and 30 by first and second braces 54 and 56 (see FIG. 2). First brace 54 includes first and second cam followers 57 and 58, respectively, as shown in FIG. 3A, for sliding engagement with first vertical support member 29. Second brace 56 also contains two cam followers (not shown) for sliding engagement with second vertical support 30.

Thus, hoist system 36 is used to raise or lower handling system 50. Specifically, actuation of foot pump 40 to cause extension of hydraulic cylinder 38 results in lowering base plate 52, and hence, handling system 50, along vertical support members 29 and 30. Actuation of foot pump 40 to cause retraction of hydraulic cylinder 38 results in raising handling system 50 along vertical support members 29 and 30.

It will be appreciated that other mechanisms may be used to raise and lower handling mechanism 50 of the present invention. For example, a rechargeable electric battery source, such as that employed in the Alum-A-Lift Model 200TF, may be used. However, the hydraulic system of the present embodiment may be advantageous over other sources of power as it provides sufficient and accurate control over the raising and lowering of handling mechanism 50 while maintaining simplicity of operation. A hydraulic power source such as hoist system 36 also limits the cost of operation, maintenance and repair of the power source. Further, hoist system 36 is lightweight and compact thereby enhancing the portability of probemat handler 20.

As shown in FIG. 1, handling mechanism 50 includes first and second jaws 60 and 62 for holding a fixture probemat therebetween. Generally, all probemats have either handles or formed edges at opposing edges thereof which are intended for use in transporting the probemat. Jaws 60 and 62 are intended to receive such handles or edges. First and second jaws 60 and 62 are operatively connected to base plate 52 by first and second side arms 64 and 66, respectively. As is described in further detail herein in association with FIGS. 4–9, jaws 60 and 62 are capable of holding a variety of probemat types and sizes, and are also capable of being tilted at an angle with respect to probemat handler 20 to permit angular placement of a probemat onto an ATE system, if so desired or required.

Referring now to FIG. 3A, there is illustrated a partial side view of the point of engagement of one side arm of the probemat handler to the base plate of the probemat handler. Specifically, the connection of first side arm 64 to base plate 52 is illustrated in FIG. 3A. Second side arm 66 is connected to base plate 52 in a like manner, as shown in FIGS. 1–2. In this embodiment, first side arm 64 is connected to and extends perpendicular away from vertical slide plate 68. Connected to and extending perpendicular from vertical slide plate 68 is horizontal slide plate 70. First and second guide wheels 72 and 74, respectively are connected to the rear side of vertical slide plate 68. Third guide wheel 76 is connected to horizontal slide plate 70. Attached to base plate 52 is middle guide rail plate 78, which, as shown in FIG. 1, extends the entire length of base plate 52.

Attached to middle guide plate 78 are first and second guide rails 80 and 82, respectively, both of which extend the entire length of middle guide plate 78 and hence the entire length of base plate 52. First guide rail 80 is located below second guide rail 82 and is positioned for engagement with first guide wheel 72. Second guide rail 82 is positioned for engagement with second guide wheel 74. Connected to the top rear edge of base plate 52 and extending the entire length of base plate 52 is third guide rail 84. Third guide rail 84 is positioned for engagement with third guide wheel 76. As seen in FIGS. 1–2, first, second and third guide wheels 72, 74 and 76 are actually representative of first, second and third sets of guide wheels. In the embodiment of FIGS. 1–2, the first set of guide wheels comprises three wheels positioned along the horizontal axis of middle guide plate 78 to engage first guide rail 80; the second set of guide wheels comprises three wheels positioned along the horizontal axis of middle guide plate 78 to engage second guide rail 82; and the third set of guide wheels comprises three wheels located on the underside of horizontal slide plate 70 to engage third guide rail 84. The use of three wheels to engage each rail provides substantial contact points to support the weight of first side arm 64 and to prevent the combination of side arm 64, vertical slide plate 68, and horizontal slide plate 70 from wobbling with respect to base plate 52.

In this embodiment, the guide wheels are of the type known as DualVee™ guide wheels, manufactured by Bishop-Wisecarver Corp., and available from Moore Bearing of Denver, Colo. The guide rails are also manufactured by Bishop-Wisecarver Corp. and are intended for use with the DualVee™ guide wheels. The use of guide rails 80, 82 and 84 with guide wheels allows first side arm 64 to move easily in a horizontal direction. The presence of third guide rail 84 and the set of third guide wheels 76 is particularly important in assisting to distribute the weight of first side arm 64 along the horizontal axis of base plate 52, and in stabilizing the position of first side arm 64 with regard to base plate 52 and frame 22. Prior art systems, such as the Alum-A-Lift lifting apparatus, only provides two guide rails—each of 20 which is located on the front surface of the base plate. Such an arrangement results in the placement of a great deal of stress on the base plate, tends to warp the guide rails and/or guide wheels, and may result in the side arms tilting downward away from the base plate or in the base plate tilting downward away from frame 22. Specifically, the wheels contact the track such that a great deal of force (created by the weight of the side arm and any probemat held therein) is applied normal to the plane of the wheel (along the axis of rotation of the wheel). In the present invention, use of the guide wheels behind the base plate places the force of the weight of the side arm and any probemat along the radial axis of the guide wheel, pressing the wheel against the track.

Figure 3B:
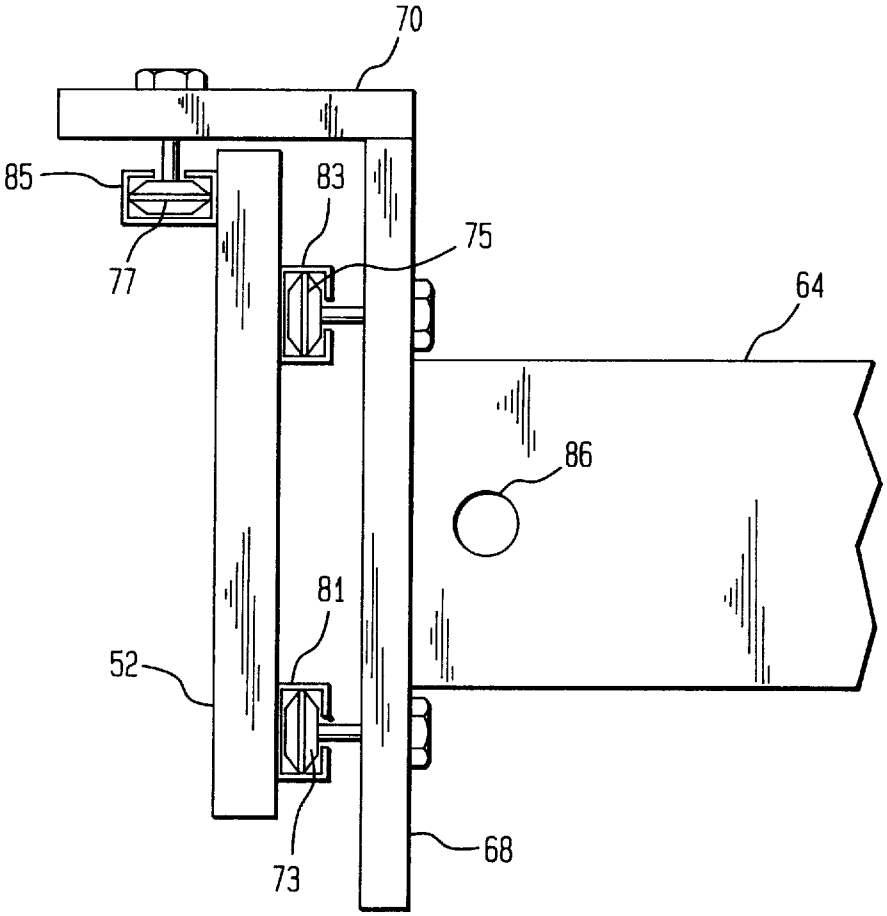
FIG. 3B illustrates a partial side view of another embodiment of the point of engagement of one side arm of the probemat handler to the base plate of the probemat handler.

It will be appreciated by those of skill in the art that the number wheels used to connect a side arm to the base plate may vary. It is possible, for example, to only require one wheel for engagement with a track, rather than the three wheels shown in the embodiment of FIGS. 1–3. The number of wheels desired is likely dependent on the weight of the side arms and the weight of probemats to be handled by probemat handler 20.

It will also be appreciated that the specific types of tracks and wheels need not be as shown in FIGS. 1–3A. The track must provide a contact means for a rolling means, such as a wheel or a roller, for sliding engagement of the side arm to the base plate. For example, in FIG. 3B, there is shown a partial side view of a second embodiment of the connection of first side arm 64 to base plate 52 of handling mechanism 50. First, second and third wheels 73, 75 and 77 engage one or more contact surfaces of first, second and third tracks 81, 83 and 85 as shown. No middle plate 78 is needed in the embodiment of FIG. 3B.

Now, referring again to FIG. 1, the connection of first side arm 64 to second side arm 66 is shown. Specifically, extending through first side arm 64 is first lead screw 86 and extending through second side arm 66 is second lead screw 88. First and second lead screws 86 and 88 are rigid and may comprise steel lead screws such as the Power-ac acme screws, Model 5/8—8 Single Start, manufactured by Nook Industries and available from Moore Bearing of Denver, Colo. The threads of first lead screw 86 and the threads of second lead screw 88 are oriented in opposition to each other. First and second lead screws 86 and 88 are joined together at lead screw joint 90. Crank 92 is connected to one end of second lead screw 88 to permit simultaneous rotation of first and second lead screws 86 and 88. Rotation of crank 92 in one direction causes first and second side arms 64 and 66 to move away from each other and away from the lead screw joint 90. Rotation of crank 92 in the opposite direction causes first and second side arms 64 and 66 to move toward each other and toward lead screw joint 90.

It will be appreciated by those of skill in the art that the horizontal translation of first and second side arms 64 and 66 is easy to achieve and control. The use of lead screws is not only cost effective, it provides for accurate separation of first and second side arms 64 and 66 to accommodate a plurality of probemats which vary in width. Further, it will be appreciated that, if desired, power sources other than the manual crank illustrated in this embodiment may be used to cause translational movement of first and second side arms 64 and 66. For example, an electric motor may be operably connected to either first or second lead screws 86 and 88 to cause rotation of first and second lead screws 86 and 88.

Figure 4:
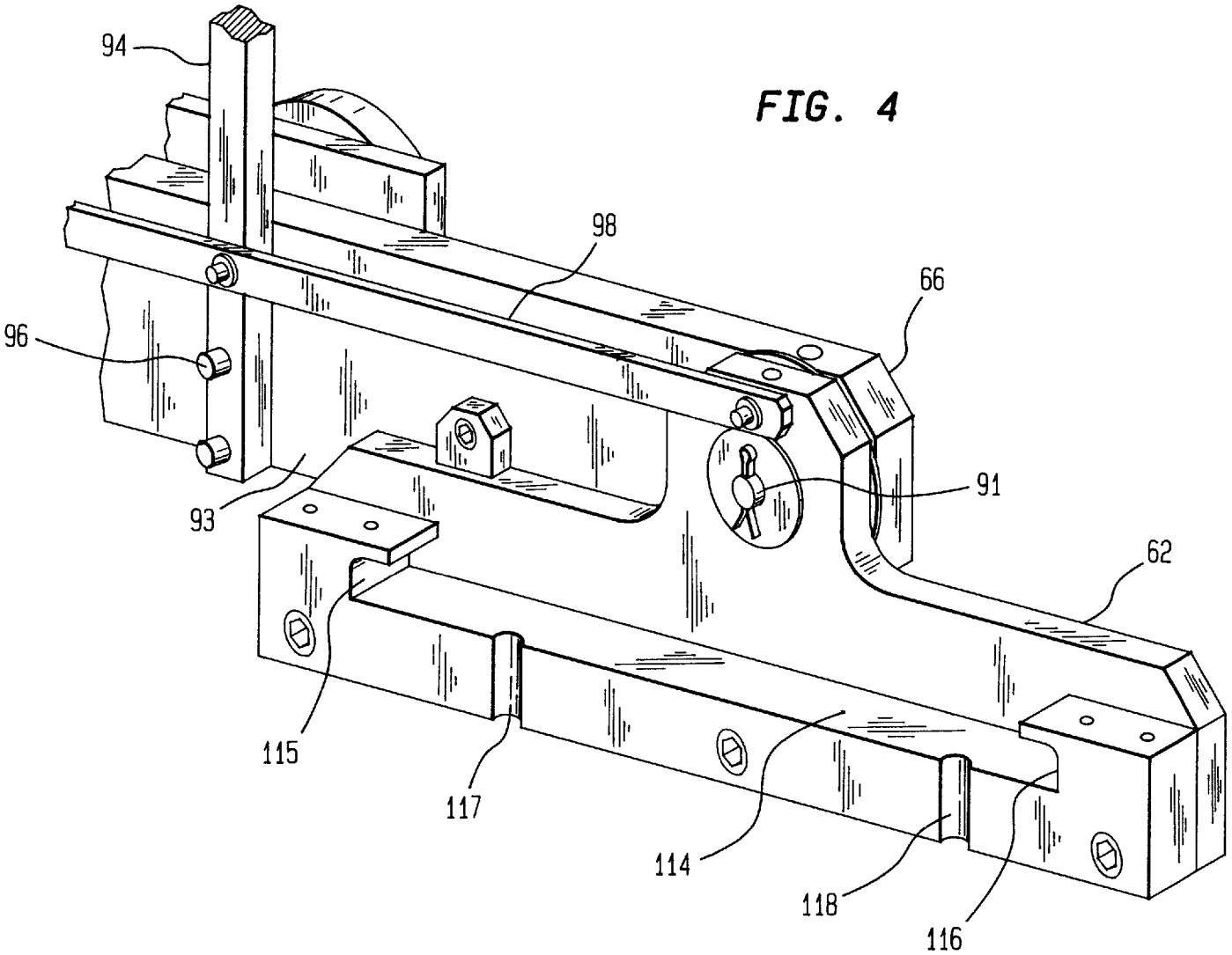
FIG. 4 illustrates an enlarged perspective view of one jaw of the probemat handler of the present invention.

FIG. 4 illustrates an enlarged perspective view of one jaw of the probemat handler of the present invention. Second jaw 62 is rotatably connected to second side arm 66 at tilting bearing 91. When in the horizontal position as shown in FIG. 4, one end of second jaw 62 rests against stop 93. Rotation of second jaw 62 with respect to second side arm 66 is accomplished by movement of lever 94 pivotally connected to side arm 66 at pivot 96. Lever 94 is also connected to connecting arm 98. Connecting arm 98 is pivotally connected to second jaw 62 as shown, such that rotation of lever 94 about pivot 96 causes second jaw 62 to tilt with respect to second side arm 66 about tilting bearing 91. In this manner, second jaw 62 may be placed at an angle for placement of a probemat held by second jaw 62 onto a non-horizontal surface as is found in some ATE systems.

In the embodiment discussed herein, first jaw 60 is pivotally connected to first side arm 64, and a stop similar to stop 93 on second side arm 66 is present to stop rotation of first jaw 60 beyond a horizontal position. The pivotal connection of first jaw 60 to first side arm 64 is free, permitting tilting of first jaw 60 is response to tilting of second jaw 62 when a probemat is placed in jaws 60 and 62. No other physical connection is present between first and second jaws 60. However, it is possible, and considered to be within the scope of the invention, that first and second jaws 60 and 62 could be physically connected to each other such that use of lever 94 to tilt second jaw 62 also causes tilting of first jaw 60 even when no probemat is held by first and second jaws 60 and 62. Such a physical connection is not necessary, however, for probemat handler 20 to be able to tilt a probemat at an angle, and therefore, such a physical connection adds unneeded cost to probemat handler 20. Such cost may, however, be justifiable, in the event probemat handler 20 is used with a flexible or fragile probemat, to reduce the stress invoked on the probemat caused by rotation of second jaw 62 about tilting bearing 91.

Figure 5A:
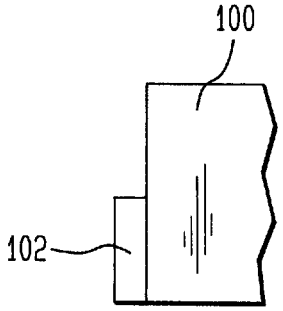
FIGS. 5A–5B illustrate a partial top view and a partial side view of one embodiment of a probemat capable of being supported by the jaw shown in FIG. 4.
Figure 5B:
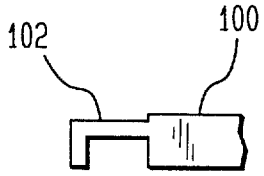

The shape of second jaw 62 is made to accommodate a plurality of different probemat types. Referring to FIGS. 5A–7B, there are illustrated partial top and side views of three different types of probemats, each having a different type of handle by which the probemat is to be held when lifted, carried, positioned or placed. The probemat of FIGS. 5A–5B is similar to the GenRad 2186 probemat which weighs approximately 54 pounds. Probemat 100 contains a handle which is shorter than the entire length of probemat 100 and which extends outward and downward from the edge of probemat 100.

Figure 6A:
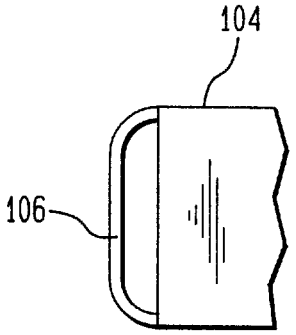
FIGS. 6A–6B illustrate a partial top view and a partial side view of a second embodiment of a probemat capable of being supported by the jaw shown in FIG. 4.
Figure 6B:
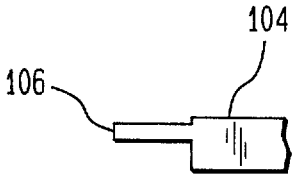
Figure 7A:
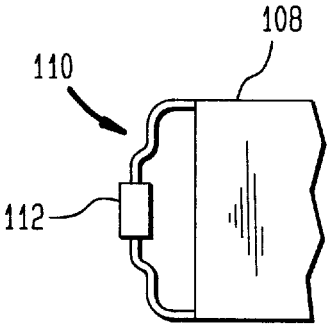
FIGS. 7A–7B illustrate a partial top view and a partial side view of a third embodiment of a probemat capable of being supported by the jaw shown in FIG. 4.
Figure 7B:
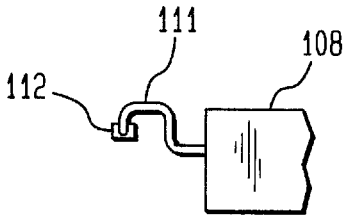

The probemat 104 of FIGS. 6A–6B is similar to the MDA Probemat by M/Rel, Inc., weighing approximately 30 to 40 pounds. Handle 106 extends the entire length of probemat 104, and extends outward and downward as shown in FIG. 6B. Finally, probemat 108 of FIGS. 7A–7B is representative of the Model SL L303 probemat manufactured by Hewlett-Packard which weighs approximately 20 pounds. Probemat handle 110 contains two bends 111 between and below which is positioned middle handle portion 112.

Second jaw 62 forms channel 114 into which a probemat handle, such as those of FIGS. 5A–7B may be inserted. Further, at the opposing ends of second jaw 62 are formed first and second stop brackets 115 and 116 to stop a probemat handle from sliding outside of the jaw. In this embodiment, second jaw 62 also has formed on the exterior wall thereof, first and second concave slots 117 and 118 formed therein. First and second slots 117 and 118 are positioned to receive bend portions 111 of the handle of the Hewlett-Packard probemat illustrated in FIGS. 7A and 7B.

The channel of second jaw 62 is illustrated as U-shaped. It will be appreciated that the channel may be of another shape, such as V-shaped, cylindrical, etc., so long as the shape of the channel accommodates receipt of a variety of probemat handle types, lengths and shapes.

Figure 8:
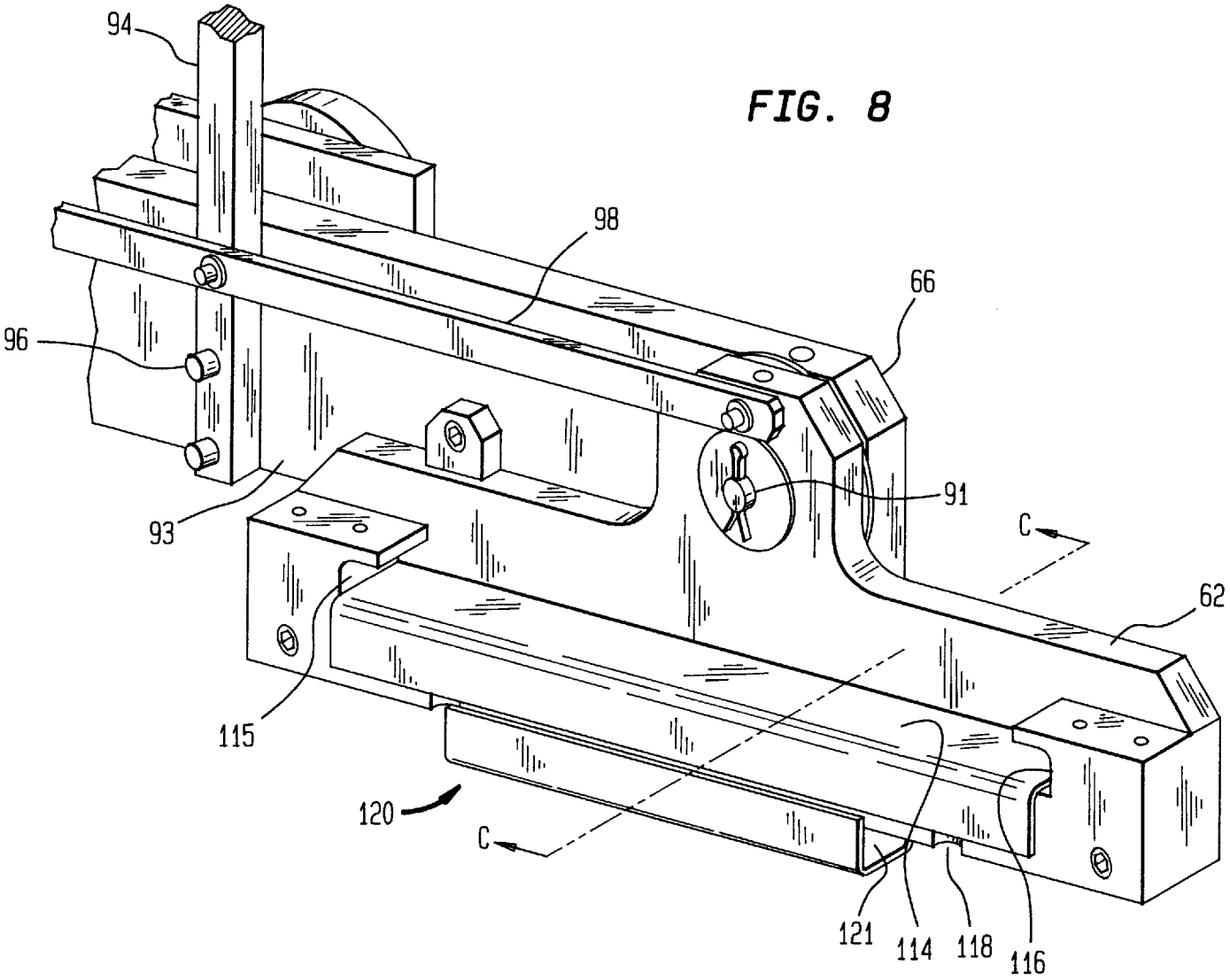
FIG. 8 illustrates an enlarged perspective view of the jaw shown in FIG. 4 having one embodiment of the jaw insert inserted therein.
Figure 9:
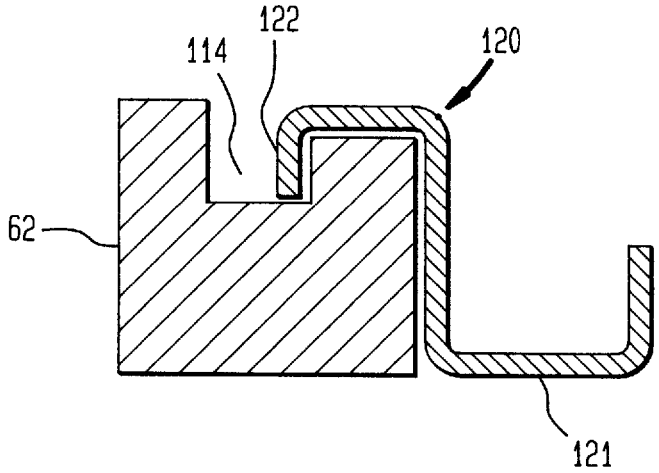
FIG. 9 illustrates a cross-sectional side view of the jaw and jaw insert taken at line C—C of FIG. 8.

To accommodate even more types of probemat handles, the present invention includes an insert for use with the jaw. FIG. 8 illustrates an enlarged perspective view of the jaw shown in FIG. 4 having one embodiment of the jaw insert inserted therein, and FIG. 9 illustrates a cross-sectional side view of the jaw and jaw insert taken at line C—C of FIG. 8. Jaw insert 120 is formed to fit within channel 114 of second jaw 62 between first and second stop brackets 115 and 116. Insert 120 then forms shelf 121 extending outside channel 114 and onto which a probemat handle or edge is placed. Thus, if the length of a probemat handle or edge exceeds the length between brackets 115 and 116 or if the handle is wider than channel 114 is wide, use of insert 120 permits probemat handler 20 to be used.

It will be appreciated by those of skill in the art that the jaw and jaw insert of the present invention allow the probemat handler to be used with a variety of probemat handle types. Inserts of shapes other than that illustrate in FIGS. 8–9 resting within the channel of the jaw may be used for specific handle types and are contemplated to be within the scope of the invention. The combination of the jaw and insert is advantageous over prior art systems requiring specific jaws to hold specific handle types. First, the jaw of the present invention is, without the insert, able to support a variety of probemat handle types. The addition of a simple, inexpensive insert assists in broadening the support of the jaw for other probemat types, such as those which may not fit into the channel of the jaw.

It will also be appreciated that the probemat handler of the present invention is suitable for use with fixtures that are not known as or referred to as "probemats". The term "probemat", as used herein and in the claims, is intended to encompass fixtures used in connection with printed circuit boards and the like for the subsequent testing thereof. "Testing" encompasses electrical tests performed by an ATE system or other electrical apparatus, as well as environmental testing, such as those performed to measure the effects of vibration, moisture, temperature, and other physical variables. The term "handles" of a fixture or probemat, as used herein and in the claims, encompasses handles attached or formed on opposing edges, or opposing edges which are formed in the fixture or probemat itself.

I claim:

1. An arrangement for handling a plurality of probemat configurations, the arrangement connecting to a stationary support member of a fixture handler, the support member having front and rear sides and a longitudinal axis defined by the length of the front and rear sides, the arrangement comprising:

first and second movable opposing side arm mechanisms, each of the first and second side arm mechanisms further comprising a side arm pivotally connected to a jaw, said jaw adapted to receive at least one handle of any one of a plurality of probemat configurations, wherein said jaw pivotally tilts about a substantially horizontal axis;

a first track connected to the front side of the support member, the first track having a contact edge and oriented along the longitudinal axis of the support member;

a second track connected to the rear side of the support member, the second track having a contact edge and oriented along the longitudinal axis of the support member;

first and second rollers for rolling engagement with the contact edge for the first track, the first roller connected to the first side arm mechanism, and the second roller connected tot he second side arm mechanism;

third and fourth rollers for rolling engagement with the contact edge of the second track, the third roller connected to the first side arm mechanism, and the fourth roller connected to the second side arm mechanism, such that the first through fourth rollers support the weight of the first and second side arm mechanisms and permit the first and second side arm mechanisms to slidably move on the first and second tracks along the longitudinal axis of the support member.

2. The arrangement of claim 1, further comprising:

a third track connected to the front side of the support member, the third track having a contact edge and oriented along the longitudinal axis of the support member; and fifth and sixth rollers for rolling engagement with the contact edge of the third track, the fifth roller connected to the first side arm mechanism and the sixth roller connected to the second side arm mechanism, such that the fifth and sixth rollers permit the side arm mechanisms to move on the third track along the longitudinal axis of the support member.

3. An apparatus for handling a fixture, the fixture having first and second opposing means for holding the fixture, the apparatus comprising:

a frame;

a handle affixed to the frame for effecting manually-powered movement of the frame;

a handling mechanism for handling the fixture, the handling mechanism including a support member operatively connected to the frame, the support member having front and rear sides and a longitudinal axis defined by the length of the front and rear sides, a first track connected to the front side of the support member, the first track having a contact edge and oriented along the longitudinal axis of the support member, a second track connected to the rear side of the support member, the second track having a contact edge and oriented along the longitudinal axis of the support member, first and second side arm mechanisms for engagement with the opposing holding means of the fixture, each side arm mechanism comprising a first roller for rolling engagement with the contact edge of the first track, a second roller for rolling engagement with the contact edge of the second track, and a side arm pivotally connected to a jaw, the jaw for receiving the opposing holding means of the fixture, a tilting actuator connected to one of the jaws, to permit tilting of that jaw with respect to the attached side arm mechanism, and wherein the first and second rollers of each side arm mechanism supports the weight of the side arm mechanism and permits the side arm mechanisms to move on the first and second tracks along the longitudinal axis of the support member.

4. The apparatus of claim 3, wherein the fixture comprises a probemat.

5. The apparatus of claim 3, wherein the support member comprises:

a base plate having front and rear sides, the rear side defining the rear side of the support member; and a middle guide plate attached to the front side of the base plate, wherein the first track is attached to the lower edge of the middle guide plate, and the second track is attached to the rear side of the base plate.

6. The apparatus of claim 3, wherein each side arm mechanism further comprises:

a third roller for rolling engagement with the first track, and a fourth roller for rolling engagement with the second track.

7. The apparatus of claim 3, wherein the frame comprises first and second vertical support members, the apparatus further comprising:

first sliding member connected to the support member and slidably engaging the first vertical support member of the frame; and second sliding member connected to the support member and slidably engaging the second vertical support member of the frame, such that the handling apparatus is allowed to slide up and down the vertical support members of the frame.

8. An apparatus for handling a fixture, the fixture having first and second opposing means for holding the fixture, the apparatus comprising:

a frame;

a handling mechanism for handling the fixture, the handling mechanism including a support member operatively connected to the frame, the support member having front and rear sides and a longitudinal axis defined by the length of the front and rear sides, a base plate having front and rear sides, the rear side defining the rear side of the support member;

a middle guide plate attached to the front side of the base plate;

a first track attached to a lower edge of the middle guide plate, the first track having a contact edge and oriented along the longitudinal axis of the support member, a second track connected to the rear side of the base plate, the second track having a contact edge and oriented along the longitudinal axis of the support member, first and second side arm mechanisms for engagement with the opposing holding means of the fixture, each side arm mechanism comprising a jaw for receiving at least one handle of any one of a plurality of probemat configurations, a first roller for rolling engagement with the contact edge of the first track, and a second roller for rolling engagement with the contact edge of the second track, wherein the the first and second rollers of each of the side arm mechanisms supports the weight of the side arm mechanisms and permits the side arm mechanisms to roll on the first and second tracks along the longitudinal axis of the support member.

9. The apparatus of claim 8 further comprising a handle affixed to the frame for effecting manually-powered movement of the frame.

* * * * *